United States Patent [19]

Lundberg

[11] 3,944,269

[45] Mar. 16, 1976

[54] SEAL

[75] Inventor: George A. Lundberg, Pompton Lakes, N.J.

[73] Assignee: E. J. Brooks Company, Newark, N.J.

[22] Filed: Sept. 18, 1974

[21] Appl. No.: 506,937

[52] U.S. Cl. ..... 292/322; 292/307 R; 24/16 PB
[51] Int. Cl.[2] ..... B65D 27/30; B65D 63/00
[58] Field of Search ..... 292/322, 318; 248/74 PB; 24/16 PB

[56] References Cited

UNITED STATES PATENTS

| | | | |
|---|---|---|---|
| 3,072,986 | 1/1963 | Lefnaer | 24/16 PB |
| 3,147,523 | 9/1964 | Logan | 24/16 PB |
| 3,402,435 | 9/1968 | Merser | 292/322 |
| 3,467,427 | 9/1969 | Moberg | 292/322 |
| 3,568,262 | 3/1971 | Woldman | 248/74 PB |
| 3,597,803 | 8/1971 | Van Neil | 24/16 PB |
| 3,666,016 | 5/1972 | Estes | 292/307 R |
| 3,830,538 | 8/1974 | Moberg | 292/322 |

*Primary Examiner*—Paul R. Gilliam
*Assistant Examiner*—Victor N. Sakran
*Attorney, Agent, or Firm*—Robert E. Ross

[57] ABSTRACT

A seal especially adapted for use on a fire extinguisher or other device, said seal providing visual evidence of operability and has means to prevent operation of the device until the seal is removed. The seal is formed of a single piece of molded plastic and is provided with an integral finger loop to facilitate removal. In a preferred embodiment of the invention, the means preventing operation of the extinguisher is a rigid bar which extends through suitable locking apertures in the operating handle and handle support, and the seal means is a socket on one end of the bar and a shackle extending from the other end.

4 Claims, 4 Drawing Figures

SEAL

BACKGROUND OF THE INVENTION

Certain types of fire extinguishers, such as the $CO_2$ type, are provided with an operating handle which is maintained in the closed position by a spring. Unintentional operation of the device is prevented by a pin extending through apertures in the handle and the handle support. The pin is wired in place by a seal of the so-called "lead and wire" type. The wire, which is easily broken, is imbedded in a lead pellet to give evidence of tampering or use. The assembly of the components of such a device is time-consuming and expensive. The use of a metal pin also has other disadvantages, in that the fire extinguisher is frequently required to be used by persons not familiar with the locking means, who try to depress the operating handle without removing the pin. Under the conditions of stress usually prevailing when a fire extinguisher is needed, the user, in applying excessive force to the handle, often bends the pin so that it is unsuitable for re-use, and in some cases the force applied has been so great that the pin has been jammed between the operating handle and the handle support, rendering the extinguisher inoperative, and so deforming the pin that it could not be removed by hand.

SUMMARY OF THE INVENTION

A seal for the above described purpose is provided which is formed of a single piece of molded plastic. The seal performs both the function of the locking pin and the lead and wire seal, and comprises an alongated rod for extending through the apertures in the operating handle and the handle support, said rod having a socket at one end and a locking shackle extending from the other end, said shackle being long enough to extend around the handle and pass into the socket in locking relation there. The shackle has a plurality of locking elements formed thereon so that the shackle can be pulled tightly around the handle for locking. An integral finger loop extends from the locking pin, so that the pulling on the finger loop both breaks the shackle and removes the pin.

DESCRIPTION OF THE ILLUSTRATED EMBODIMENT

Figure 1:
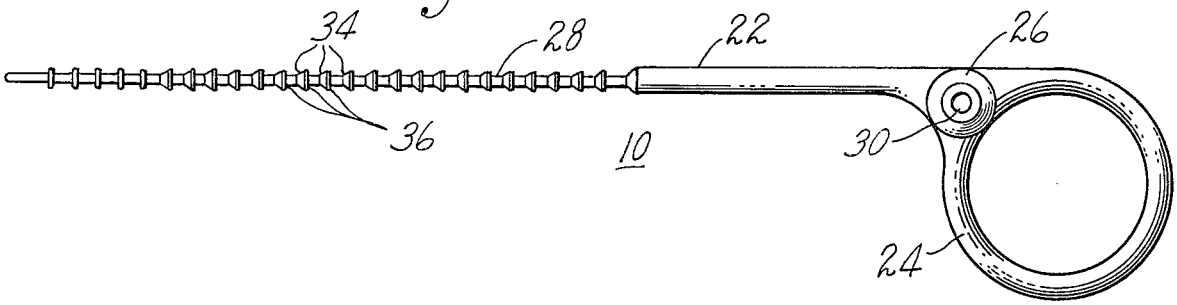
FIG. 1 is a top plan view of a seal embodying the features of the invention.
Figure 2:
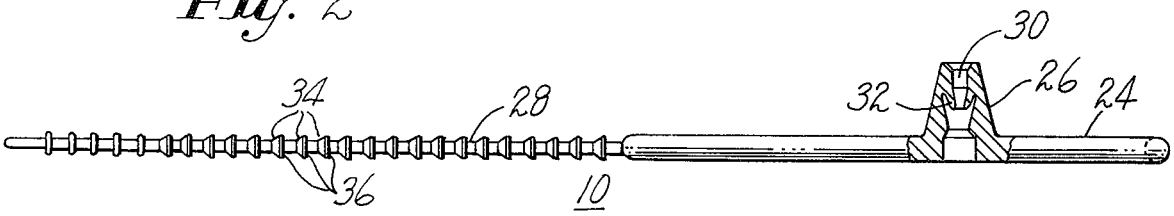
FIG. 2 is a view in side elevation of the seal of FIG. 2.
Figure 3:
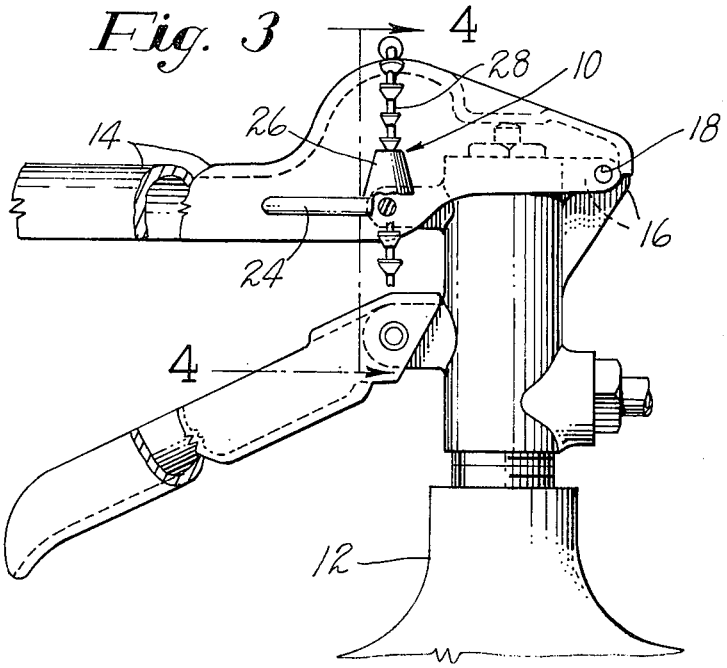
FIG. 3 is a view in side elevation of a fire extinguisher with the seal of FIGS. 1 and 2, assembled therewith.
Figure 4:
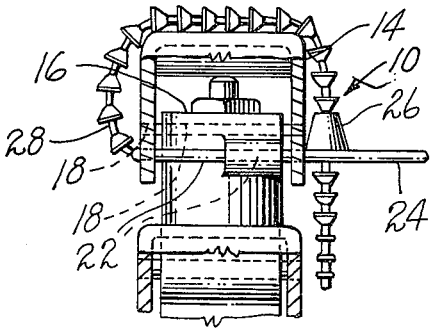
FIG. 4 is a view of the assembly of FIG. 3 as seen from the right side.

Referring to the drawing there is illustrated a seal 10 which is particularly adapted for use with a fire extinguisher 12 of the $CO_2$ type, which has a valve operating handle 14 carried on a handle support 16. The handle 14 is normally biased to the closed position, as shown, by a spring (not shown) and when in this position apertures 18 in the handle are aligned with apertures 20 in the handle support.

The seal 10 is formed of a single piece of molded plastic, and comprises a locking pin 22, a finger loop 24 disposed at one end of the locking ring, a socket 26 projecting upwardly from the junction of the finger loop with the locking pin, and a shackle 28 extending from the opposite end of the locking pin.

In the illustrated embodiment the socket 26 and the shackle 28 comprising a seal of the type shown in U.S. Pat. No. 3,467,427, issued Sept. 16, 1969, with the socket comprising a hollow body having an internal passage 30 extending therethrough and internal fingers 32. The shackle 28 has a plurality of circumferential camming surfaces 34 leading to locking shoulders 36, which are sized and positioned so that the shackle may be pulled through the socket, whereby the fingers 32 are flexed outwardly by each camming surface 34 and snap back behind the shoulder 36, thereby preventing backward movement of the shackle through the socket.

The seal 10 is assembled with the fire extinguisher by inserting the shackle 28 and pin through the aligned openings 18 and 20. The end of the shackle may then be inserted into the top of the socket and drawn tightly around the handle, so that the shackle is locked in place. The seal can thereafter be removed only by fracturing the shackle.

The seal described herein has a number of advantages over the metal locking pin with lead and wire seal previously used. First, the cost of the seal and the assembly cost is less than that of a metal pin with a separate seal. Second, the pin is disposable after each use, thereby eliminating the problems created by the re-use of pins which are bent or otherwise damaged. Third, since the pin is made of plastic, when an excessive force is applied to the operating handle, as by a person in a state of panic, the pin will be sheared by the handle, allowing the extinguisher to be operated.

Although in the illustrated embodiment, the seal locking structure is similar to that described and claimed in the above mentioned U.S. Patent, it will be understood that this is by way of example only, since other forms of locking seals may be used if desired. For example, although the excess length of shackle allows the seal to be used on devices with handles of various size and shape, a seal with a single locking element on the end of a shackle of predetermined length may be used on a fire extinguisher of known size.

Although the specific embodiment illustrated herein is particularly designed for use as a combination locking pin and seal on a fire extinguisher, it will be understood that the principles of the invention may be applied to other devices in which a rigid pin combined with a locking seal is required.

Since certain other obvious changes may be made in the illustrated embodiment of the device without departing from the scope of the invention, it is intended that all matter contained herein be interpreted in an illustrative and not a limiting sense.

I claim:

1. A seal for use with a device having an operating handle disposed on a handle support with apertures in the handle and support which are aligned when the handle is in the non-operating position, said seal comprising a rigid pin sized to closely fit and extend through the apertures and project from each side of the handle, a socket disposed at one end of the pin and a flexible shackle extending from the opposite end of the pin, said shackle having a central core having a diameter substantially less than that of the pin so as to be easily bendable and a series of locking enlargements formed thereon, said enlargements having a diameter not greater than that of the pin, and having a length such that it can pass around the handle and enter the socket, said socket having means for receiving said locking enlargements in non-separable engagement.

2. A seal as set out in claim 1 which has a finger loop extending from the end of the pin having the socket.

3. A seal according to claim 2 in which the pin is formed of material capable of being sheared by an excessive force applied to the operating handle.

4. A seal for insertion into the locking apertures of the operating lever of a fire extinguisher for both locking and sealing the lever, said seal being formed of a single piece of plastic and comprising an elongated solid relatively inflexible pin having a diameter such that it substantially fills the locking apertures when assembled therein, a socket formed at one end of the pin and having an aperture extending therethrough with internal resilient fingers, and a flexible shackle extending from the other end of the pin, said shackle having a central core having a diameter substantially less than that of the pin and a series of locking shoulders formed thereon having a diameter not greater than that of the pin and having a length great enough to pass around the handle and through the socket, and a finger loop extending from the end of the pin carrying the socket, said shackle having a tensile strength such that it can be readily broken by a pull on the finger loop to remove the pin from the apertures, said pin being of a strength such that it can be sheared when a greated than normal force is applied to the operating lever.

* * * * *